US005267762A

United States Patent [19]

Gromotka

[11] Patent Number: 5,267,762

[45] Date of Patent: Dec. 7, 1993

[54] LATCH WITH CONNECTING PARTS FORMING A SEAL

[75] Inventor: Gabriel Gromotka, Caledonia, N.Y.

[73] Assignee: Southco, Inc., Concordville, Pa.

[21] Appl. No.: 838,313

[22] Filed: Feb. 20, 1992

[51] Int. Cl.[5] ..... E05C 9/08

[52] U.S. Cl. ..... 292/229; 292/DIG. 31; 292/113

[58] Field of Search ..... 292/DIG. 31, 229, 246, 292/250, 247, 113

[56] References Cited

U.S. PATENT DOCUMENTS

| | | | |
|---|---|---|---|
| 3,026,133 | 3/1962 | Swanson | 292/DIG. 31 |
| 3,030,137 | 4/1962 | Cheney | 292/113 |
| 3,034,817 | 5/1962 | Willis | 292/DIG. 31 |
| 3,209,563 | 10/1965 | Pelcin | 70/208 |
| 3,237,978 | 3/1966 | Swanson | 292/113 |
| 3,259,412 | 7/1966 | Wheeler | 292/113 |
| 3,542,410 | 11/1970 | Poe | 292/113 |
| 3,998,481 | 12/1976 | Anthone | 292/113 |
| 4,114,424 | 9/1978 | Johnson . | |
| 4,134,281 | 1/1979 | Pelcin | 70/208 |
| 4,159,137 | 6/1979 | Richter . | |
| 4,268,072 | 5/1981 | Bohleen et al. | 292/DIG. 31 |
| 4,318,557 | 3/1982 | Bourne et al. . | |
| 4,372,591 | 2/1983 | Cook et al. . | |
| 4,487,440 | 12/1984 | Beijer . | |
| 4,510,779 | 4/1985 | Ahad | 70/208 |
| 4,602,812 | 7/1986 | Bourne | 292/113 |
| 4,693,503 | 9/1987 | Bisbing . | |
| 4,743,052 | 5/1988 | Stammreich et al. | 292/113 |
| 4,778,207 | 10/1988 | Gergoe | 292/DIG. 31 |
| 4,826,221 | 5/1989 | Harmon . | |
| 4,828,299 | 5/1989 | Poe . | |
| 4,877,274 | 10/1989 | Poe . | |
| 4,880,261 | 11/1989 | Bisbing | 292/DIG. 31 |
| 4,925,221 | 5/1990 | Carmody et al. | 292/DIG. 31 |
| 4,991,885 | 2/1991 | Poe . | |
| 5,064,228 | 11/1991 | Bisbing | 292/DIG. 31 |

FOREIGN PATENT DOCUMENTS

| | | | |
|---|---|---|---|
| 0259108 | 9/1988 | European Pat. Off. . | |
| 2189539 | 10/1987 | United Kingdom | 292/113 |

OTHER PUBLICATIONS

Eberhard Manufacturing Co., (Ohio, 1988), pp. I10-I13.

The Hartwell Corporation, (California, 1984) five pages.

Southco Fasteners Handbook, (Southco, Inc., Pennsylvania, 1990) pp. E15-E18.

Southco Fasteners Handbook 40, (Southco, Inc., Pennsylvania 1990), p. F-2.

*Primary Examiner*—Eric K. Nicholson

*Attorney, Agent, or Firm*—Paul & Paul

[57] ABSTRACT

The present invention provides a sealed level latch for securing a door panel of a cabinet or the like in a closed position relative to the frame. The sealed lever latch is installed within an aperture formed in the door, and releasably retains the door against the frame when the door and the frame are latched together. The sealed lever latch includes a housing for mounting in the door, a handle assembly which is pivotally attached to the housing, and rotatable between an opened and closed position, and a fastening means. The fastening means retains the door, when the door is closed against the frame, by engaging the frame as the handle assembly is rotated to the closed position. The housing, handle assembly and fastening means form a integral solid structure for preventing the passage of matter through the latch itself. The sealed lever latch further includes a biasing means which is adapted to retain the handle assembly in the closed position, and urge the handle assembly from the closed position to the opened position upon disengagement. A trigger means is also included for latching the handle assembly in the closed position, and unlatching the handle assembly from the closed position for movement to the opened position. The trigger means which is integrally disposed within the central vicinity of the handle assembly provides increased mechanical advantage during the closing thereof.

10 Claims, 2 Drawing Sheets

LATCH WITH CONNECTING PARTS FORMING A SEAL

BACKGROUND OF THE INVENTION

1. Field of the Invention

The present invention relates generally to latching devices and more particularly to lever latches for fastening hinged doors, panels and the like.

2. Brief Description of the Prior Art

Various types of latching devices for fastening doors, panels and the like are known.

Some types incorporate a spring to bias a latch bolt into a latched position about a keeper. Rotary handles are provided so that the latch bolt may be rotated away from the keeper in opposition of the spring, and into an unlatched position. However, the handle of such a latch which extends beyond the body may cause inadvertent latching and unlatching in response to impact forces.

In U.S. Pat. No. 4,693,503, a lever latch is shown comprising a flanged housing, a handle and a latch which are inserted within an opening in a cabinet door or the like. The handle is provided with an arm and a stop which compresses against an inner surface of the cabinet frame when the door is closed and latched. The handle and latch are positioned substantially flush with the outer door surface when the handle and the latch are in the latched position. However, the construction of the latch is such that dirt, water and other matter is able to pass through the latch and into the interior compartment of the cabinet, thus causing damage to the equipment contained therein. A latex boot is oftentimes utilized which covers the back of the latch, however, this only provides partial sealing for the latch.

There is a need for a lever latch which will not only maintain a panel door in a closed position, but will also restrict the passage of matter through the latch itself.

SUMMARY OF THE INVENTION

The present invention provides a sealed lever latch for mounting within a door panel of a cabinet or the like for releasably retaining the door against the corresponding frame. The sealed lever latch includes a housing, a handle assembly and a fastening means. The handle assembly, which is pivotally attached to the housing, is rotatable between an opened and closed position. The fastening means retains the door in the closed position against the frame when the handle assembly is rotated to the closed position.

Advantageously, the present invention provides a sealed lever latch which is capable of restricting the passage of matter through the latch itself.

It is a further advantage of the present invention to provide a biasing means in a sealed lever latch which is capable of retaining the handle assembly in the closed position, and also urging the handle assembly from the closed position to the opened position upon unlatching.

It is still a further advantage of the present invention to provide a trigger means in a sealed lever latch which is integrally disposed within the central vicinity of the handle assembly for providing increased mechanical advantage during the closing thereof.

DETAILED DESCRIPTION OF THE PREFERRED EMBODIMENTS

Figure 1:
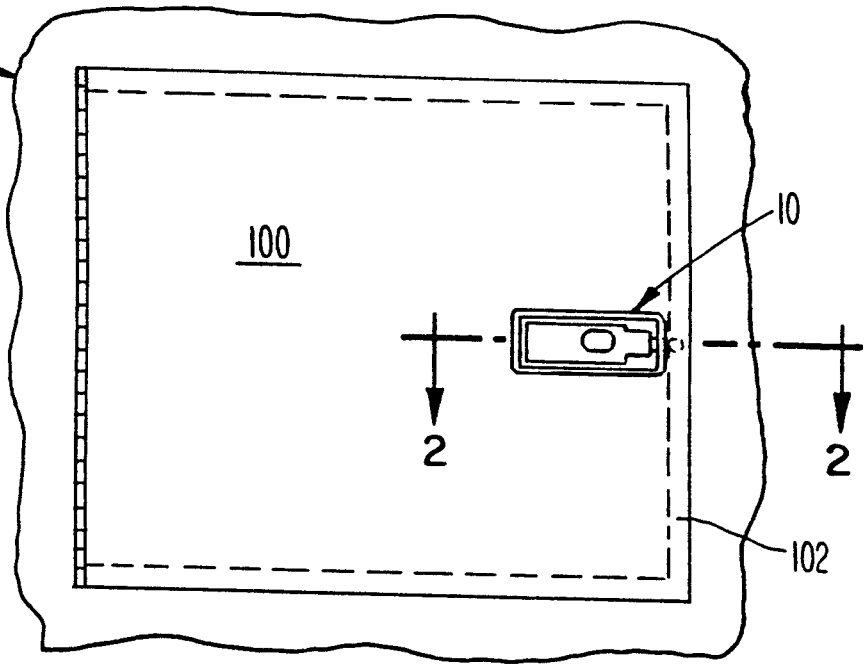
FIG. 1 is a perspective view of a sealed lever latch of the present invention shown mounted in a door of a cabinet, partly broken away, for securing the door to the cabinet frame, the door being shown in a closed position.

Referring now to the drawings in detail, wherein like reference numerals indicate like elements throughout the several views, there is shown in FIG. 1 a perspective view, partly broken away, of a cabinet 101 having a sealed lever latch 10 of the present invention mounted in a door 100 thereof. The cabinet 101 ma be fabricated from any suitable type of material for enclosing various equipment installed therein (not shown). Accordingly, the door 100 as illustrated in phantom in FIG. 1 is hinged to the cabinet 101 for engaging a cabinet frame 102 in a closed position. A gasket (not shown) may be affixed to the inside of the door 100 proximate the edge thereof for providing additional sealing of the door 100 when closed against the frame 102.

Figure 2:
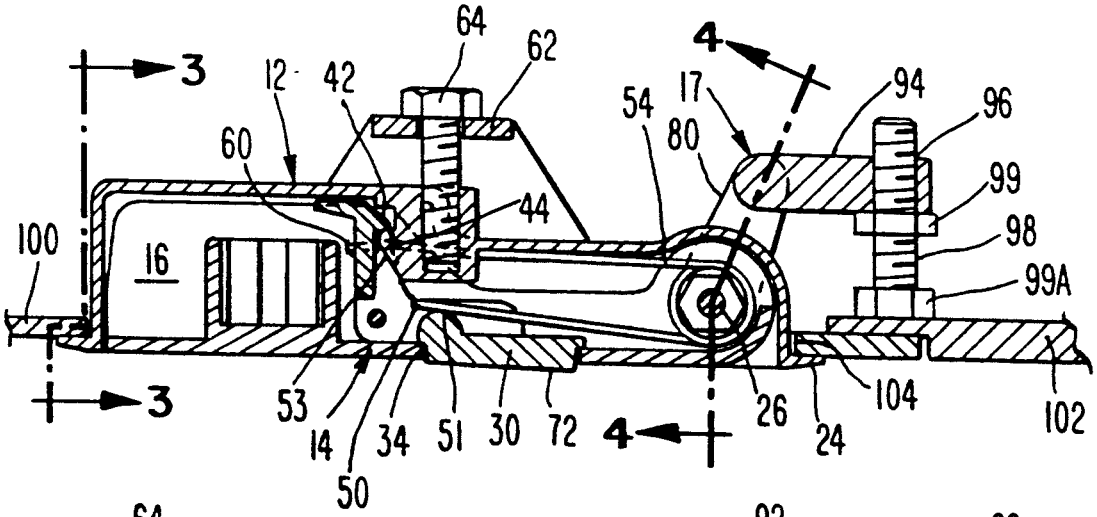
FIG. 2 is a sectional view of the sealed lever latch taken along the line 2—2 of FIG. 1.

As shown in FIG. 2, the sealed lever latch 10 according to the present invention includes a housing 12 for mounting in an aperture 104 formed in the door 100, a handle assembly 14 pivotally attached to the housing 12, and rotatable between an opened and closed position, and a fastening means 16 for engaging the cabinet frame 102 in the closed position thereof.

Figure 3:
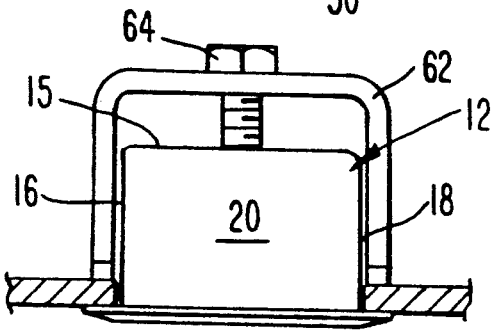
FIG. 3 is a sectional view of the sealed lever latch taken along the line 3—3 of FIG. 2.
Figure 6:
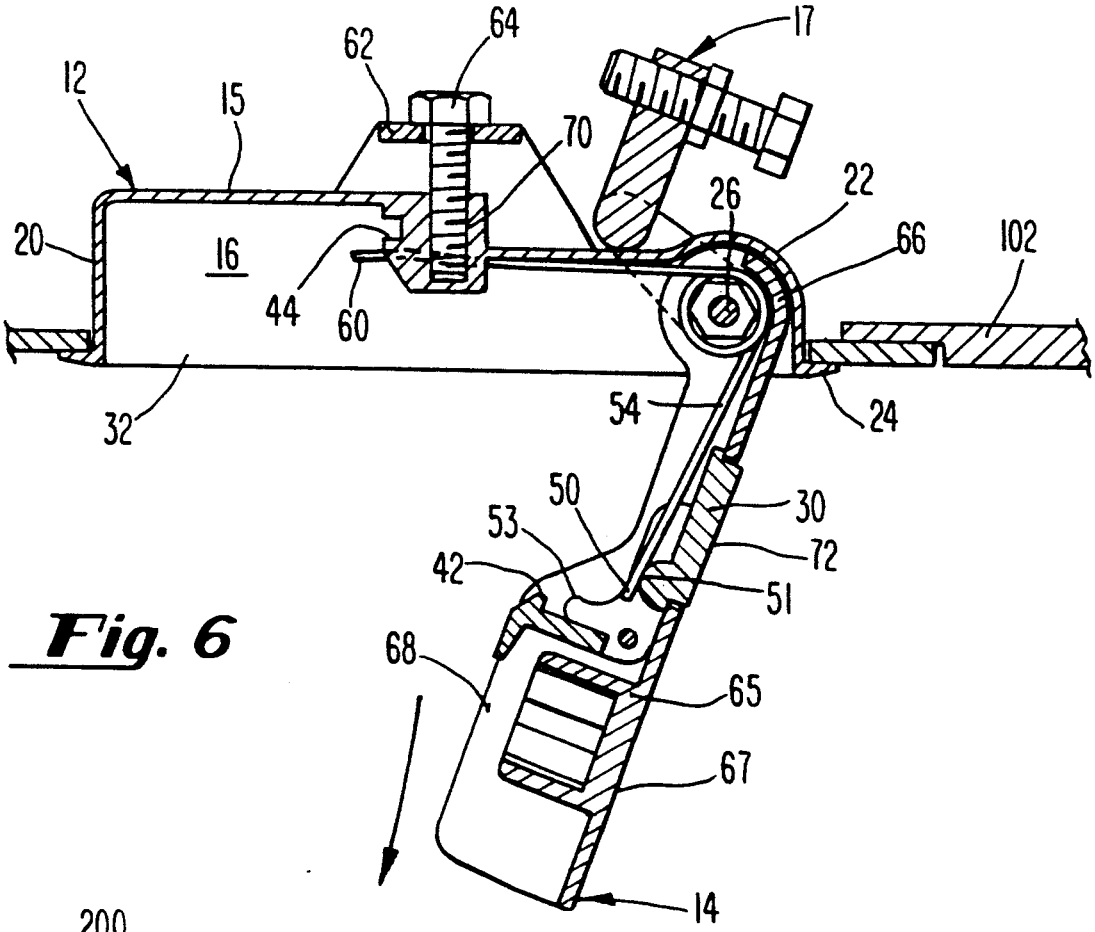
FIG. 6 is a sectional view of the sealed lever latch of FIG. 2 shown in an opened position.

As best seen in FIGS. 3 and 6, the housing 12 is a generally rectangular, cup-like member that is preferably of a zink die cast. However, the housing 12 according to the present invention may be produced by any appropriate method from any suitable material. Accordingly, housing 12 comprises a bottom plate 15, and a pair of generally parallel side walls 16, 18 and first and second end walls 20 and 22 extending perpendicularly upward therefrom. As best illustrated in FIG. 6, a well 32 is formed between the respective side walls 16, 18 and end walls 20, 22 for housing the handle assembly 14 when in the closed position of FIG. 2. A flange 24 is also provided extending outward from the free ends of sidewalls 16, 18 and end walls 20, 22 for abutting an outer surface of door 100, when housing 12 is mounted proximate the aperture 104 thereof. A sealing means of the gasket type (not shown) may be affixed to the underside of flange 24 for sealing the flange 24 against the outer surface of the door 100 when the housing 12 is mounted therein. Preferably, the flange 24 of the present invention is sized to prevent the passage of matter around the latch 10, through the aperture 104, and into the interior compartment of cabinet 101. Accordingly, oftentimes, it is necessary to incorporate a larger sized flange, preferably about five millimeters in length, in order to account for imperfections in the preparation of door 100 when the housing 12 is mounted therein.

Figure 5:
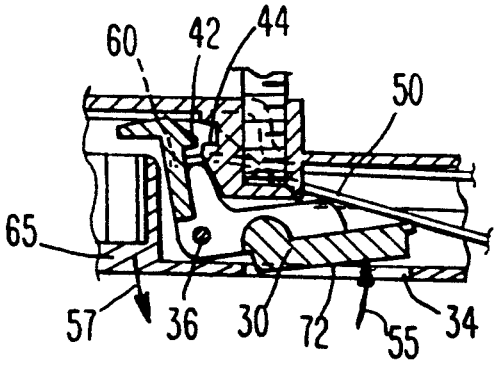
FIG. 5 is a fragmentary sectional view of the trigger of the sealed lever latch shown in a rotated position.

As shown in FIG. 3, the housing 12 is secured within the aperture 104 by the mounting bracket 62. The bracket 62 is received over the outer surface of housing 12 engaging the inner surface of door 100 shown in FIG. 3. The bracket 62 is held in this position, engaging the door 100, by a threaded bolt 64. The bolt 64 is inserted through an opening formed in bracket 62, engaging the threads 70 provided in bottom plate 15, as shown in FIG. 5.

As previously described, an important feature of the present invention is to prevent the passage of matter through the latch 10, into the interior compartment of the cabinet 101. Accordingly, in the preferred embodiment of the present invention illustrated in FIGS. 2 and 3, the sidewalls 16, 18 are each provided with a corresponding opening 25 (not shown in FIGS. 2 and 3) formed therethrough adjacent end wall 22, for receiving the handle assembly 14 and fastening means 17 in the manner described below. At assembly, housing 12, handle assembly 14 and fastening means 17 form an integral solid structure for preventing the passage of matter through the sealed lever latch 10.

As shown in FIG. 6, the handle assembly 14 includes a pivot 65 having a first end 66, an upper surface 67 and opposing side walls 68 (only one of which is visible) extending downward from upper surface 67. Oppositely situated apertures 26 are formed adjacent the first end 66 of pivot 65, within the respective side walls 68 thereof, for receiving the fastening means 17 in the manner described below.

Figure 4:
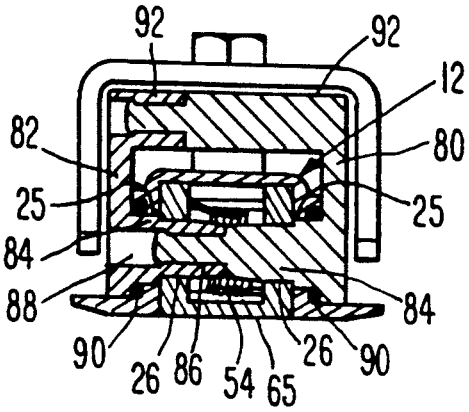
FIG. 4 is a sectional view of the sealed lever latch taken along the line 4—4 of FIG. 2.

As best seen in FIGS. 2 and 4, the fastening means 17 includes first and second lever members 80 and 82, each having respective first shafts 84 extending from a first end thereof. The first shafts 84 are configured to be received within the openings 25, formed within the sidewalls 16, 18 of the housing 12, and apertures 26 of the pivot 65, respectively. Preferably, the first shafts 84 are hexagonal in cross-section over a section thereof in order to be press fit within the correspondingly configured hexagonal openings 25, and apertures 26, respectively. It should be understood, however, that any appropriately configured first shafts 84, and openings 25 and apertures 26 may be provided for such purpose. As shown in FIG. 4, the first shafts 84 are also formed in such a manner to matingly interconnect along the distal ends thereof, thereby forming a one piece integral shaft member upon assembly. Preferably, the first shaft 84 of first lever member 80 includes an integral rivet member 86 protruding outward therefrom. Accordingly, the rivet member 86 is adapted to be received and peened over within a correspondingly configured receptacle 88, formed through the first shaft 84 of the second lever member 82, for completing the assembly. It is to be understood, however, that any appropriate method may be used for this purpose. A sealing means 90 of the O-ring type may also be included which is received over the respective first shafts 84 for providing additional sealing for the housing 12 against the first shafts 84, respectively. Preferably, the sealing means 90 is of an electrically conductive material for preventing the passage of electromagnetic radiation, however, the sealing means 90 according to the present invention may be produced from any suitable material.

As shown in FIGS. 2 and 4, the first and second lever members 80 and 82 are also provided with respective second shafts 92 extending from a second end thereof. The second shafts 92 are adapted to interconnect in the manner described above, also forming a one piece integral shaft member upon assembly.

As best illustrated in FIGS. 2 and 4, the second shaft 92 of the first lever member 80 is provided with a bracket 94 extending therefrom which includes a threaded opening 96 at its distal end. An adjustable bolt 98 is mounted in the threaded opening 96 and is locked in a fixed position by the action of nut 98. The head 99A of adjustable bolt 99 is positioned to contact the back surface of the frame 102 when handle assembly 14 is moved to its closed and latched position illustrated in FIG. 2.

As shown in FIGS. 2 and 5, the handle assembly 14 also includes a trigger 30 for latching and unlatching the handle assembly 14 from the closed position. As best seen in FIG. 5, the trigger 30 is rotatably mounted onto pivot 65 by a connecting member 36, for example of the spring pin type, the ends of which extending through the aligned apertures formed through the opposing side walls 68 of pivot 65, and trigger 30, respectively. Preferably, as illustrated in FIGS. 2 and 6, the connecting member 36 or second biasing means rotates an outer surface 72 of trigger 30 upward, into the opening 34 formed within the center of pivot 65. Accordingly, the trigger 30 and pivot 65 are contiguous and flush with the flange 24 of housing 12 in the closed and latched position of FIG. 2.

As shown in FIGS. 2, 5, and 6, the trigger 30 also includes a catch 42 formed at the bottom thereof. The catch 42 is adapted to engage in a latched position a keeper 44 formed in the housing 12, when the door 100 is closed against the frame 102 and the handle assembly 14 is rotated to the closed position shown in FIG. 2. As indicated earlier, it is believed that the position of trigger 30 integrally disposed within the vicinity of the center of the handle assembly 14 provides increased mechanical advantage during the closing operation thereof.

As shown in FIGS. 2, 4, and 6, a biasing means 54 of the torsion spring type is included mounted onto the first shafts 84 for retaining the catch 42 in engagement with keeper 44 by the ends 50, 60 thereof. Preferably, the ends 50, 60 retain the trigger 30 in the latched position of FIG. 2 by engaging and urging upward trigger 30 along a lower side 51, opposite outer surface 72, and a flange 53, formed adjacent the catch 42, respectively.

As shown in FIG. 5, application of force by an operator downward upon outer surface 72 of trigger 30, in the direction of arrow 55, rotates the catch 42 away from keeper 44, and the ends 50, 60 of biasing means 54 urge the trigger 30, and accordingly handle assembly 14, upward in the direction of arrow 57 from well 32. Whereafter, the fastening means 17 is moved out of contact with frame 102, as the handle assembly 14 is rotated to the opened and unlatched position of FIG. 5 by the force of the biasing means 54.

Figure 7:
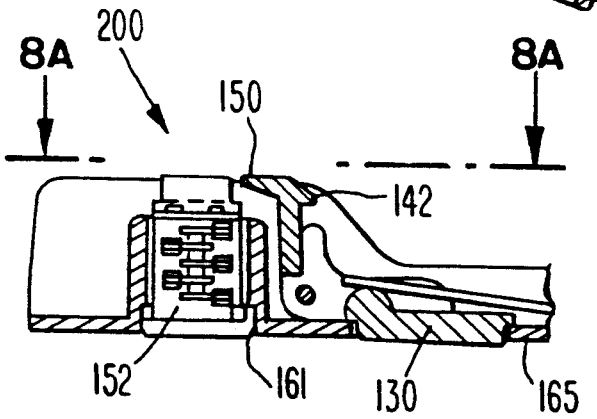
FIG. 7 is a fragmentary sectional view of an alternative embodiment of the sealed lever latch of the present invention.
Figure 8A:
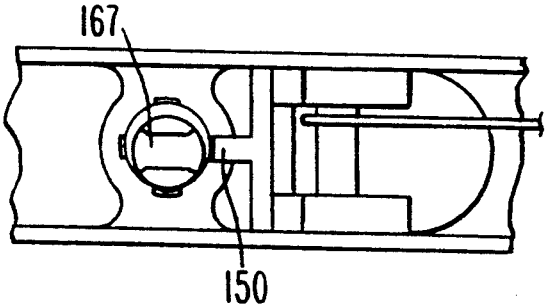
FIG. 8A is a plan view of the sealed lever latch taken along the line 8A—8A of FIG. 7 shown in a closed and unlocked position.
Figure 8B:
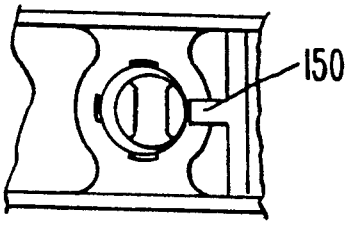
FIG. 8B is a fragmentary plan view of the sealed lever latch of FIG. 7A shown in a closed and locked position.

In FIG. 7 is shown an alternate embodiment of the sealed lever latch of the present invention. A conventional key lock 152 is shown mounted in an aperture 161 formed within the pivot 165 for locking the sealed lever latch 20 in the closed position thereof. As illustrated, the trigger 130 includes a tongue 150 extending therefrom opposite the catch 142. As best seen in FIGS. 8A and 8B, the tongue 150 is configured to extend within a locking slot 167 formed in the lower end of lock 152 when in the unlocked position, and abut against the lower end of the lock 152 when the sealed lever latch 200 is closed and locked.

It will be recognized by those skilled in the art that changes may be made to the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. A lever latch adapted to be mounted in an aperture formed in a door panel for releasably retaining the door against a corresponding frame, the latch comprising:

a housing, a handle assembly pivotally attached to the housing, the handle assembly being rotatable between an opened and a closed position, and fastening means, the fastening means engaging the frame for retaining the door when the handle assembly is rotated to its closed position, wherein the housing, handle assembly and fastening means are integrally connected forming a seal for preventing the passage of matter through the latch and thereby through the aperture when the latch is mounted therein.

2. The lever latch of claim 1, wherein the housing includes flange means extending outward a sufficient amount therefrom for engaging an outside surface of the door for preventing the passage of matter around the latch and through the aperture when the latch is mounted therein.

3. The lever latch of claim 2, further including means for securing the handle assembly in the closed position, means for disengaging the handle assembly from the closed position, and biasing means, the biasing means being adapted for retaining the handle assembly in the closed position and urging the handle assembly from the closed position to the opened position upon disengagement.

4. The lever latch of claim 3, wherein the housing includes a keeper engaging the handle assembly when the handle assembly is in the closed position.

5. The lever latch of claim 4, wherein the securing and disengaging means includes a trigger means pivotally mounted on and integrally disposed within the handle assembly, the trigger means engaging the keeper when the handle assembly is moved to the closed position, and the biasing means retaining the trigger means in the closed position and urging the trigger means and handle assembly to the opened position when the trigger means is disengaged from the keeper.

6. The lever latch of claim 5, wherein the handle assembly includes an opening extending therethrough adapted for receiving the trigger means.

7. The sealed lever latch of claim 6, wherein the biasing means is in engagement with the handle assembly with trigger means, whereby the trigger means is contiguous with an outer surface of the handle assembly in the closed and opened positions thereof.

8. The lever latch of claim 5, further including locking means integrally disposed within the handle assembly for retaining the trigger means in engagement with the keeper when in a closed and locked position thereof.

9. A lever latch adapted to be mounted in an aperture formed in a door panel for releasably retaining the door against a corresponding frame, the latch comprising:

a housing, a handle assembly pivotally attached to the housing, the handle assembly being rotatable between an opened and closed position, fastening means, the fastening means engaging the frame for retaining the door when the handle is assembly is rotated to its closed position, wherein the housing, handle assembly and fastening means are integrally connected forming a seal for preventing the passage of matter through the latch and thereby through the aperture when the latch is mounted therein, flange means extending outward a sufficient amount from the housing for engaging an outside surface of the door for preventing the passage of matter around the latch and through the aperture when the latch is mounted therein, means for securing the handle assembly in the closed position, wherein the housing includes a keeper for engaging the handle assembly when the handle assembly is in the closed position, means for disengaging the handle assembly from the closed position and biasing means, the biasing means being adapted for retaining the handle assembly in the closed position and urging the handle assembly from the closed position to the opened position upon disengagement, wherein the securing and disengaging means includes a trigger means pivotally mounted on and integrally disposed within the handle assembly, the trigger means engaging the keeper when the handle assembly is moved to the closed position, and the biasing means retaining the trigger means in the closed position and urging the trigger means and handle assembly to the opened position when the trigger means is disengaged from the keeper, the handle assembly further including an opening extending therethrough adapted for receiving the trigger means.

10. The lever latch of claim 9, further including locking means, the locking means integrally disposed within the handle assembly for retaining the trigger means in engagement with the keeper when in a closed and locked position thereof, the handle assembly including an opening extending therethrough adapted for receiving the locking means.

* * * * *

UNITED STATES PATENT AND TRADEMARK OFFICE

CERTIFICATE OF CORRECTION

PATENT NO. : 5,267,762

DATED : December 7, 1993

INVENTOR(S) : Gabriel Gromotka

It is certified that error appears in the above-indentified patent and that said Letters Patent is hereby corrected as shown below:

Column 2, line 30, "ma be" should read --may be--.

Signed and Sealed this

Tenth Day of May, 1994

*Attest:*

*Attesting Officer*

BRUCE LEHMAN

*Commissioner of Patents and Trademarks*